United States Patent [19]

Weiss et al.

[11] 4,030,651

[45] June 21, 1977

[54] INTERFLOOR TUBE ASPIRATOR MUFFLER

[75] Inventors: William Robert Weiss, Walnut Creek, Calif.; James Judson Cooksey, Colonial Heights, Va.; Wilbur Leon Stables, Matoaca, Va.; Harry Lee Newell, Jr., Richmond, Va.

[73] Assignee: Allied Chemical Corporation, Morris Township, N.J.

[22] Filed: Sept. 21, 1976

[21] Appl. No.: 725,055

[52] U.S. Cl. ..... 226/97; 28/271; 181/33 K

[51] Int. Cl.[2] ..... B65H 17/32; C10K 11/04

[58] Field of Search ..... 181/33 R, 33 C, 33 G, 181/33 K; 226/7, 97; 425/72, 211; 28/1.4, 72.12, 71.3, 1 R

[56] References Cited

UNITED STATES PATENTS

| | | | |
|---|---|---|---|
| 2,764,250 | 9/1956 | Jeffords | 181/33 C |
| 3,167,847 | 2/1965 | Gonsalues | 28/1.4 |
| 3,305,910 | 2/1967 | Clement | 28/1.4 |
| 3,510,038 | 5/1970 | Bundy et al. | 226/7 |
| 3,713,509 | 1/1973 | Carroll | 181/33 K |
| 3,905,075 | 9/1975 | Boggs | 28/71.3 X |
| 3,917,141 | 11/1975 | Sartori | 226/97 |

*Primary Examiner*—Louis K. Rimrodt
*Attorney, Agent, or Firm*—Richard A. Anderson

[57] ABSTRACT

A muffler for use in conjunction with an interfloor tube and aspirating means during the production of multifilament, synthetic yarn is provided. Audible noise which is emitted at the exit end of the interfloor tube is reduced by up to 33.5 ΔdB(A) and brought to within acceptable levels through the use of a perforated tube, resonant chambers, and sound absorbing means.

12 Claims, 7 Drawing Figures

INTERFLOOR TUBE ASPIRATOR MUFFLER

BACKGROUND OF THE INVENTION

This invention relates to an apparatus for use during the production of multifilament, synthetic yarn. In particular, it relates to a muffler, for use in conjunction with an interfloor tube and aspirating means, which reduces by up to 33.5 ΔdB(A) the noise emitted at the exit end of the interfloor tube when the aspirating means is operational.

Throughout the present specification and claims, the term "dB(A)" (decibels - A-weighted) connotes a unit of measurement of sound level corrected to the A-weighted scale, as defined in ANSI S1.4–1971, using a reference level of 20 micropascals ($2 \times 10^{-5}$ Newtons per square meter). The term "ΔdB(A)" refers to the difference between two noise levels where each level is expressed in units of dB(A). The term "yarn" is employed in a general sense to indicate strand material, either textile or otherwise, and including a continuous, often plied, strand composed of fibers, filaments, glass, metal, asbestos, paper, or plastic, or a noncontinuous strand such as staple, and the like. An "end" is one of a contiguous group of such strands of yarn.

The invention is applicable to many phases of yarn handling, the particular use disclosed herein being merely illustrative and not limiting thereof.

In a typical melt spinning process, one or more filaments is extruded from one or more spinnerettes and passed into a quenching chamber for cooling. Further process equipment, for instance drawing or winding apparatus, is usually spaced a considerable distance vertically downward therefrom. In fact, it is normal practice to have the process equipment spaced over three tiers with the extrusion apparatus occupying the uppermost tier or floor, the quenching apparatus occupying the intermediate floor, and any further process equipment residing on the bottom floor. In order to convey the yarn from the quenching area to the bottom floor, it is conventional to provide an interfloor tube. To initiate string-up, an operator cathces the advancing quenched filaments and throws them towards the entrance to the interfloor tube through which they fall to be picked up by either a string-up aspirator or a panel aspirator. Aspirating means is usually employed in conjunction with the interfloor tube for one of two reasons. First, it is often necessary to accelerate the speed of the yarn to extrusion speed as the yarn does not fall fast enough by itself due to drag. Second, the smaller the inner diameter of the interfloor tube is, the greater the necessity for aspirating means due to the drag on the yarn. Therefore, to initiate string-up, aspirating means for use in conjunction with the interfloor tube should be turned on and remain on until the yarn end or ends thrown therethrough have been picked up by either a panel aspirator or a string-up aspirator, at which time is turned off.

The aspirating means is located at the inlet portion of the interfloor tube where high velocity air is introduced and directly downwardly to create the desired suction effect. Noise is produced at and downstream of the point at which this high velocity air is introduced. The sound waves thus generated are then propagated primarily through the exit end of the interfloor tube. Noise issuing from the exit end impinges on the lower floor operator who picks up the yarn ends to continue string-up. The noise emitted, as measured 6 inches and 90° from the center line of the interfloor tube exit end with an air supply line pressure of 90 psig, has been found to exceed 110 dB(A) in some instances without use of this invention. The frequency component of the interfloor tube noise is situated in the high frequency levels, i.e., greater than 2,000 cycles per second, which has been shown to be more harmful than the low frequency levels.

The high level noise from the interfloor tube occurs only during string-up, but as a minor component in a process which has several other sources of noise, it is desirable to bring its noise level down to tolerable limits. There are several approaches to noise reduction in a work environment. One is the use of hearing protection devices such as helmets, ear plugs, or each muffs by the operator exposed to the noise. The protection afforded, however, relates directly to proper use and maintenance of the devices. The difficulty, from a managerial viewpoint, lies in getting the operator to use these protective devices. To avoid this problem, applicants have provided a muffler which reduces the noise emitted at the exit end of the interior tube by up to 33.5 ΔdB(A) and which thereby brings the noise to within acceptable levels.

SUMMARY OF THE INVENTION

The present invention provides an apparatus for use to convey a continuous running length of yarn through an obstruction during the production of multifilament synthetic yarn. The essential elements are an elongated tube, a source of air under pressure, and a muffler.

The elongated tube has an entrance and an exit end of yarn passage. A source of air under pressure is connected to the elongated tube so as to create suction therethrough when operational.

The muffler is located downstream of the source of air under pressure and is connected to and replaces a portion of the elongated tube corresponding in length to the muffler. The muffler comprises housing means, a perforated tube, a plurality of baffle means, and sound absorbing material. The housing means comprises an inlet end, an outlet end, and an elongated section extending therebetween. the inlet end is shaped so as to couple with the elongated tube downstream of the source of air under pressure without blocking yarn passsage therethrough; the outlet end is shaped so as to couple with the elongated tube upstream of the exit end thereof without blocking yarn passage therethrough. The perforated tube has a diameter substantially smaller than the diameter of the housing means and is disposed between the inlet and outlet ends of the housing means. The perforated tube has an open area of from 40 to 60%. The baffle means are disposed approximately perpendicular to the central axes of the perforated tube and the housing means and are shaped so as to encircle the perforated tube with their peripheries being surrounded by the elongated section of the housing means. The baffle means form, in conjunction with the perforated tube and the housing means, a plurality of annular resonant chambers. A sound absorbing material is disposed throughout each of the resonant chambers.

Means is provided for connecting the inlet end of the housing means with the elongated tube downstream of the source of air under pressure; means also is provided for connecting the outlet end of the housing means with the elongated tube upstream of the exit thereof.

When the source of air under pressure is operational, the noise level of the apparatus is reduced up to 33.5 ΔdB(A) by the muffler. The invention will be more clearly understood and additional objects and advantages will become apparent upon reference to the discussion below and to the drawings which are given for illustrative purposes.

DETAILED DESCRIPTION OF THE DRAWINGS

Figure 1:
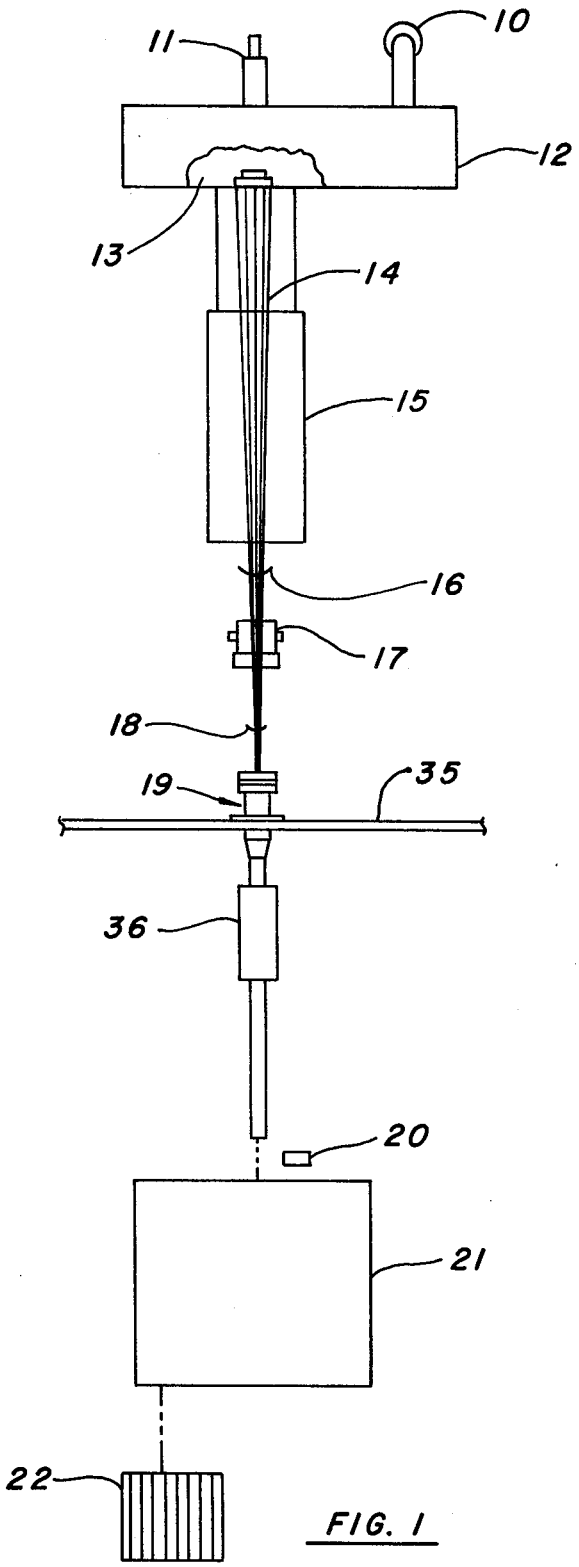
FIG. 1 is a schematic illustration showing the apparatus of the present invention in relation to other apparatus in the production of multifilament, synthetic yarn.

In the accompanying drawings, like numbers indicate like apparatus. Referring to FIG. 1, molten polymer is fed by extruder 10 to spin pump 11 which feeds spin block 12 containing conventional spin pots (unshown) and a spin pot spinnerette 13. A plurality of filaments forming yarn end 14 are extruded from spinnerette 13 and quenched in quench chamber 15. Yarn end 14 then passes through first convergence guide 16 and over lube roll 17, through second convergence guide 18 and on to interfloor tube 19 shown in detail in FIGS. 2 through 5. From interfloor tube 19, yarn end 14 passes to drawn panel 21 and is then wound up on package 22. Panel aspirator 20 may optionally be placed to one side of th yarn path downstream of interfloor tube 19. Interfloor tube 19 conveys a continuous running length of yarn through any obstruction such as a floor.

With reference to FIGS. 2 through 5, the interfloor tube 19 of the preferred embodiment has as its major elements a generally cylindrical yarn passage 23, a generally cylindrical tube 24, a source of air under pressure 58 (FIG. 3), a duct 31 (FIG. 3), a restrictor plate 32, a muffler 36, and a yarn outlet tube 55.

Figure 2:
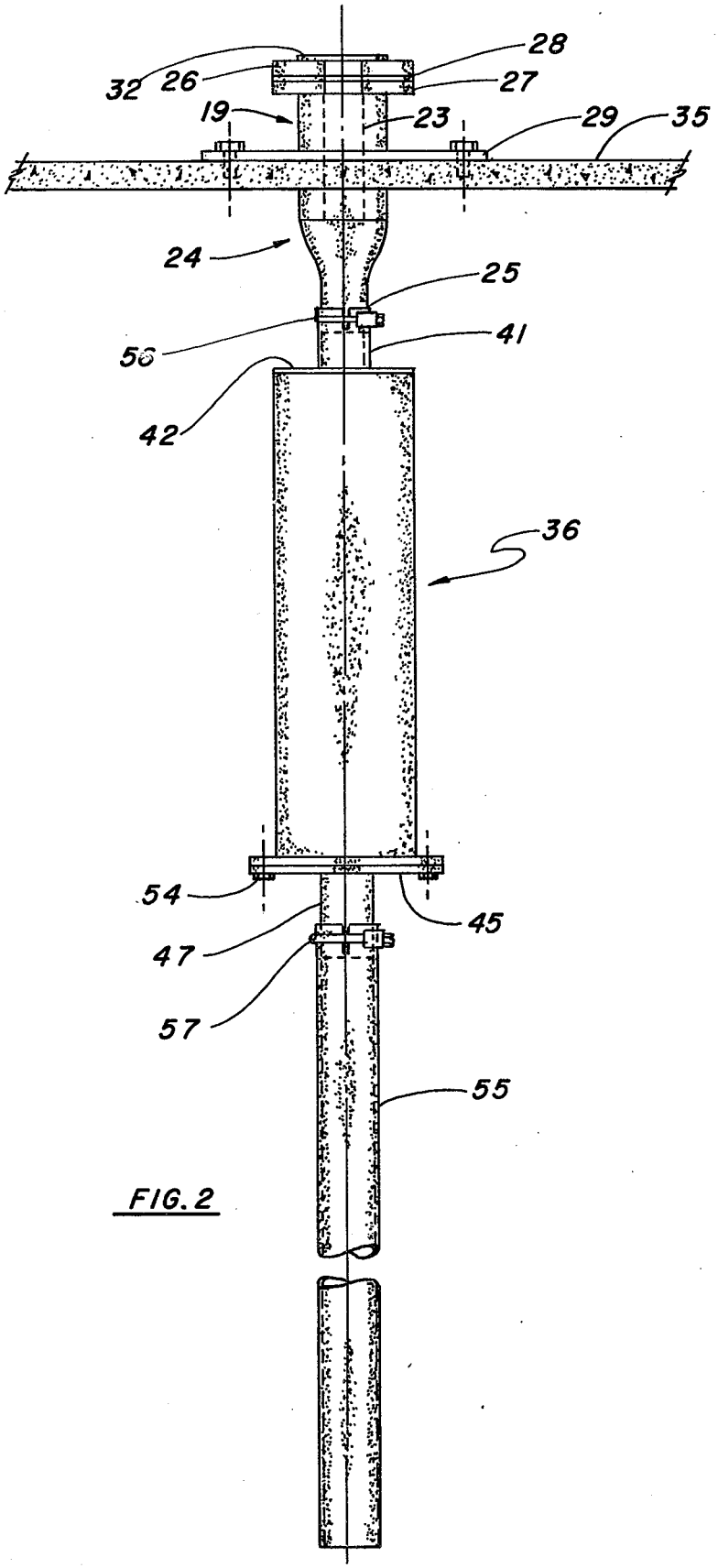
FIG. 2 is a front elevational view of the interfloor tube labelled 19 in FIG. 1.
Figure 3:
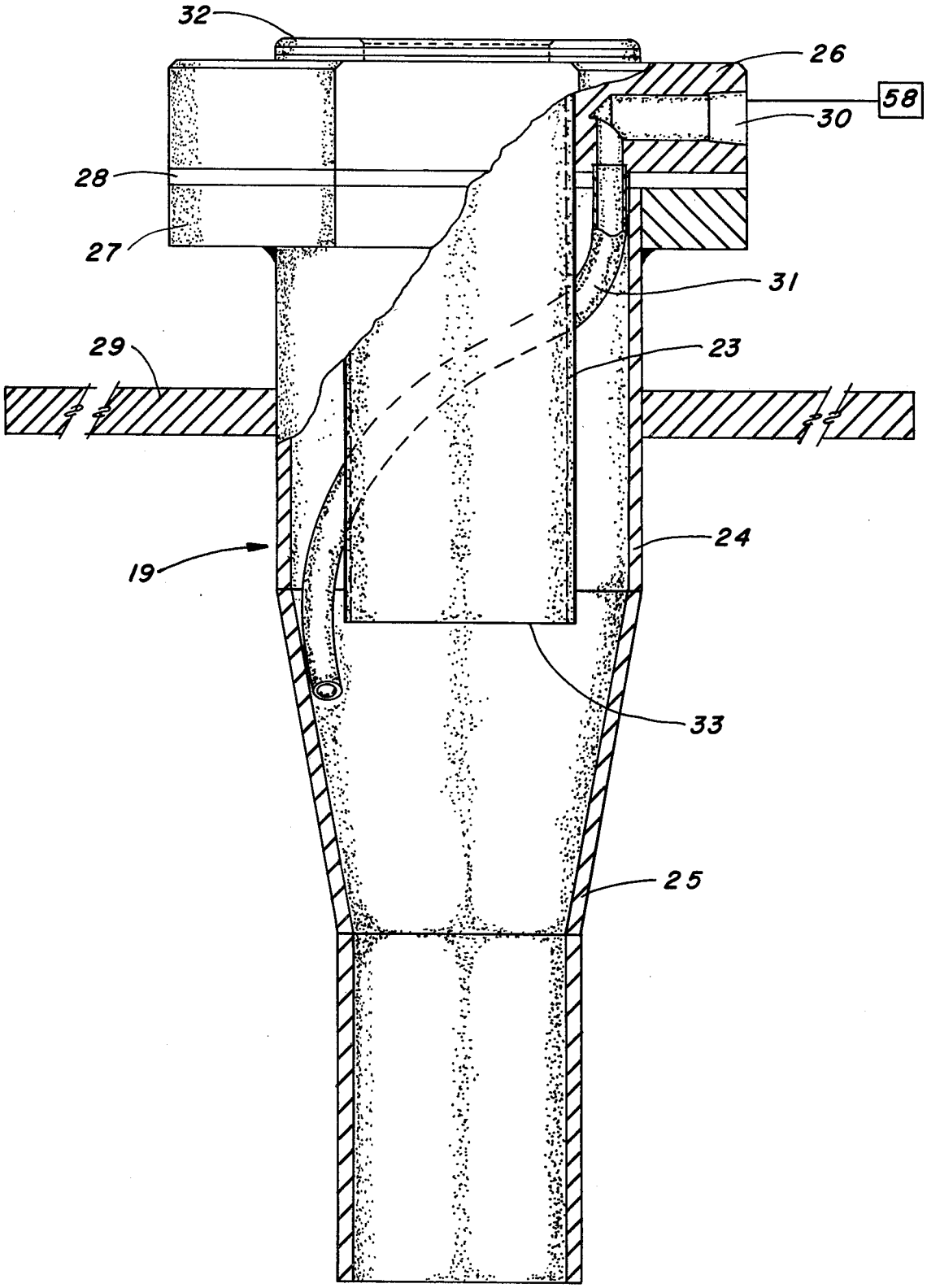
FIG. 3 is a sectional view of that portion of interfloor tube 19 upstream of muffler 36.
Figure 4:
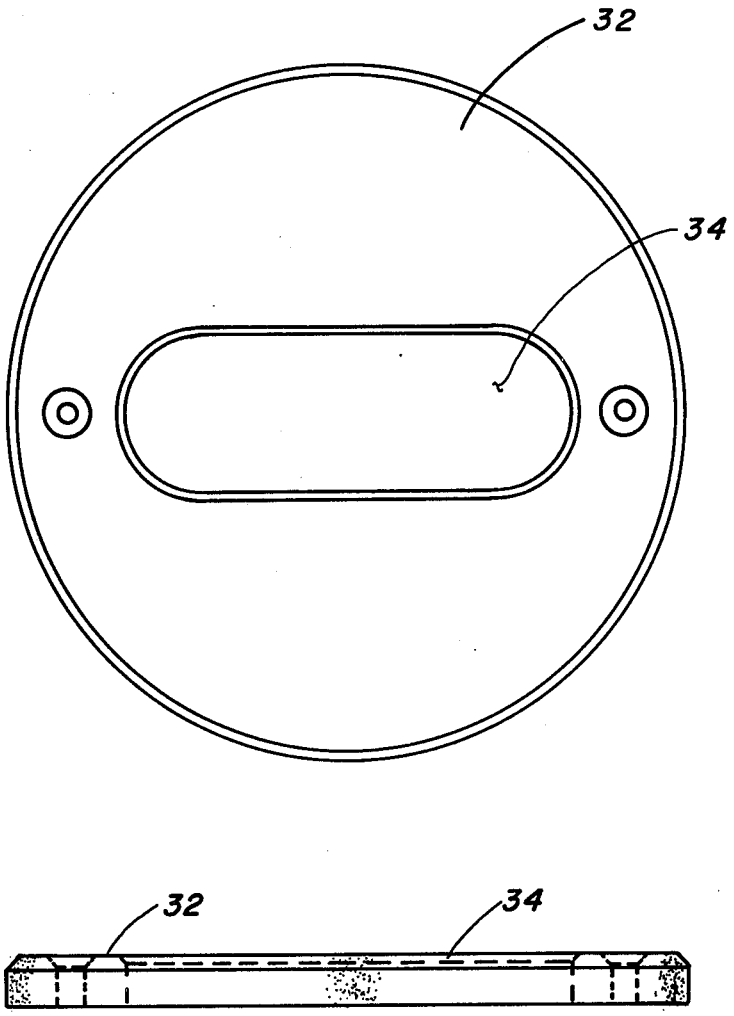
FIG. 4 is a plan and elevation view of restrictor plate 32.

FIG. 3 particularly out the aspirating portion of interfloor tube 19. Cylindrical tube 24 and yarn passage 23 are concentric with respect to one another, with cylindrical tube 24 having a substantially larger diameter and surrounding yarn passage 23. Cylindrical tube 24 starts a gradual inward taper at that point corresponding to exit end 33 of yarn passage 23, and tapers to a neck 25 having a diameter approximately equal to that of yarn passage 23 and downstream thereof. Means for mounting yarn passage 23 and cylindrical tube 24 in fixed relation to one another is provided and is depicted (see FIGS. 2 and 3) as first 26 and second 27 flanges of respectively, yarn passage 24 and cylindrical tube 24. Sealing means 28 maintains first 26 and second 27 flanges in fluid tight relationship and can comprise a resilient, readily deformable elastomeric material, for example, a rubber gasket or a conventional O-ring seal. Duct 31 is connected to a source of air under pressure 58 (shown schematically through cylindrical tube 24 at the portion thereof farthest away from the portion which tapers. FIG. 3 shows duct 31 connecting to inlet pipe 30 which is adapted for connection to a source of air under pressure 58. Duct 31 describes a half helical turn about the exterior of yarn passage 23 in the annular space left between yarn passage 23 and cylindrical tube 24. Duct 31 terminates just below exit end 33 of yarn passage 23 where that portion of cylindrical tube 24 tapers. Duct 31 delivers air under pressure to create suction by the Bernoulli effect at the tapered portion of tube 24, when the source of air under pressure 58 is triggered by suitable means. With reference to FIGS. 2, 3, and 4, restrictor plate 32 is mounted (for instance by bolts) so as to cover the entrances to yarn passage 23 and cylindrical tube 24. Restrictor plate 32 has an opening 34, confined to that area covering yarn passage 23, to restrict entrance of air to the opening 34. Opening 34 has an area which is approximately 25 to 75% of the cross sectional area of yarn passage 23. A third flange 29 encircles cylindrical tube 24 at a point between second flange 27 and neck 25 and functions to both support and locate interfloor tube 19 with respect to floor 35.

Referring to FIGS. 2, 5, 6, and 7, muffler 36 is connected to cylindrical tube 24 and has as its major elements housing means 37 and a sound absorbing insert 44. Housing means 37 comprises a generally cylindrical body 38 having inlet 39 and outlet 40 ends, a first inlet projection 41, an annular wall 42, and a second inlet projection 43. First inlet projection 41 is generally cylindrical and hollow and extends outward from inlet end 39 of body 38, with which first inlet projection 41 is concentric. First inlet projection 41 has a diameter substantially smaller than that of body 38 and slightly larger than that of cylindrical tube 24 at neck 25 to which first inlet projection 41 is adapted for connection. Annular wall 42 connects body 38 and first inlet projection 41 and lies in a plane substantially perpendicular to the central axis of body 38. Second inlet projection 43 is generally cylindrical and hollow and extends inward from inlet end 39 of body 38, with which second inlet projection 43 is concentric. Second inlet projection 43 has a diameter slightly smaller than that of first inlet projection 41 and is connected to annular wall 42. The edge portion of annular wall 42 disposed between first 41 and second 43 inlet projections is beveled.

Figures 6, 7:
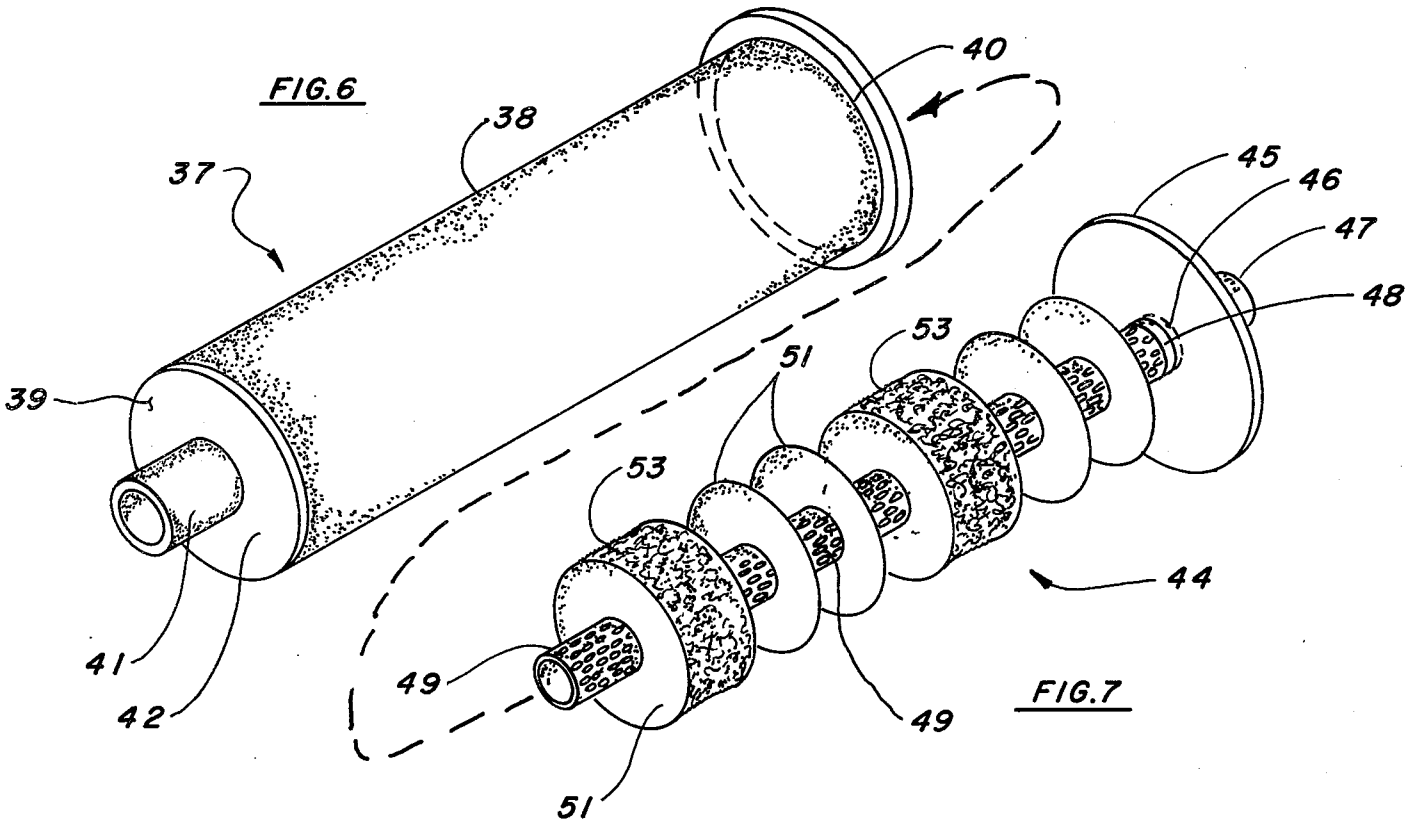
FIG. 6 is an isometric view of housing means 37 of muffler 36.
FIG. 7 is an isometric view of sound absorbing insert 44 of muffler 36.

With reference to FIG. 6, sound absorbing insert 44 comprises an end plate 45, a generally cylindrical perforated tube 49, a plurality of annular baffles 51, sound absorbing material 53, and means for fixedly assembling the elements thereof.

End plate 45 lies in a plane substantially parallel to annular wall 42 and is adapted for removable connection to outlet end 40 of body 38 of housing means 37. End plate 45 has an orifice 46 therethrough communicating with first 47 and second 48 generally cylindrical and hollow outlet projections. First outlet projection 47 extends outward from the plane of end plate 45 and is concentric with body 38 when end plate 45 is connected thereto. First outlet projection 47 has a diameter similar to that of first inlet projection 41. Second outlet projection 48 has a diameter slightly larger than that of first outlet projection 47 and extends inward from the plane of end plate 45. Second outlet projection 48 also is concentric with body 38 when end plate 45 is connected thereto. Orifice 46 in end plate 45 has a periphery defined by first 47 and second 48 outlet projections with that edge portion of end plate 45 which is disposed therebetween being beveled.

Perforated tube 49 has a plurality of perforations 50, the diameters of which are between 0.0675 and 0.0825 inch and which create an open area for perforated tube 49 from 40 to 60%. The ratio of the length of perforated tube 49 to the inside diameter of perforated tube 49 is between 6.2 to 1.0 and 15.5 to 1.0; perforated tube 49 has an outside diameter slightly smaller than that of second outlet projection 48 and an inside diameter slightly larger than that of second inlet projection 43. In use, perforated tube 49 is slideably engaged with the exterior of second inlet projection 43. Perforated tube 49 extends to and is mounted to the interior of second outlet projection 48 and end plate 45 is connected to outlet end 40 of body 38 of housing means 37. The central axis of perforated tube 49 substantially coincides with that of body 38.

Figure 5:
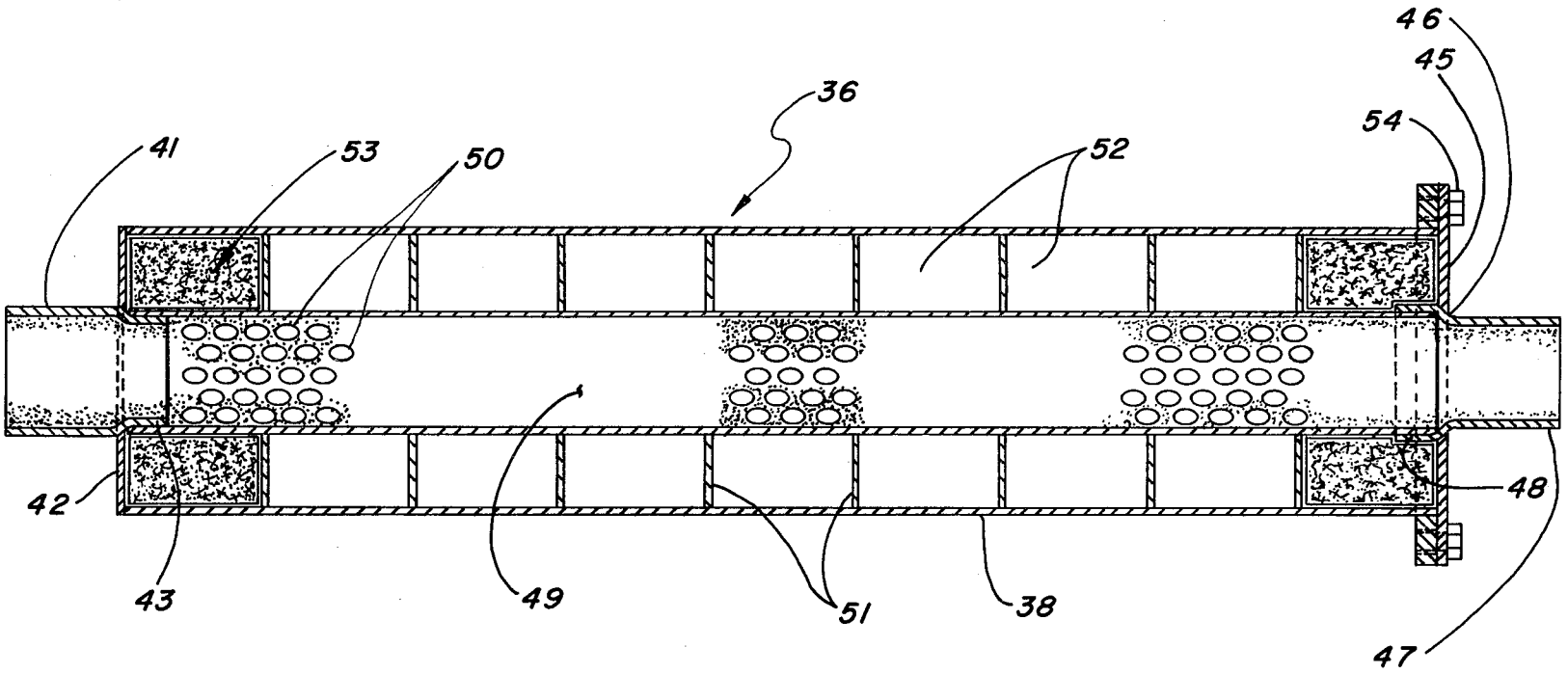
FIG. 5 is a sectional view of muffler 36 of the present invention.

Annular baffles 51 are connected to and encircle perforated tube 49 in a plane substantially perpendicular to the central axis thereof. The peripheries of annular baffles 51 are defined by body 38 when end plate 45 is connected thereto. Annular baffles 51 are disposed at substantially equal intervals and such that the ratio of the inside diameter of perforated tube 49 to the distance between two adjacent baffles is from 0.64 to 1.0 and 2.0 to 1.0; the distance between the baffle 51 nearest annular wall 42 and annular wall, and the distance between the baffle 51 nearest end plate 45 and end plate 45 is the same and approximately equal to the distance between two adjacent baffles 51. Baffles 51 form in conjunction with perforated tube 49, body 38, annular wall and end plate 45 as a plurality of annular resonant chambers 52 when end plate 45 is connected to outlet end 40 of body 38 of housing means 37. Sound absorbing material 53 is disposed throughout and within each of annular resonant chambers 52. FIGS. 5 and 7 show sound absorbing material 53 in only some of chambers 52 to better show details, and avoid heavy shading throughout. Means is provided for fixedly assembling the elements of sound absorbing insert 44, for example, welding or a press fit for points of contact between perforated tube 49 and second outlet projection 48 and baffles 51 and perforated tube 49.

Means is also provided for connecting end plate 45 of sound absorbing insert 44 to body 38 of housing means 37, for example, bolts 54 as depicted in FIG. 5.

With reference to FIG. 2, yarn outlet rtube 55 has a diameter slightly larger than second outlet tube 48 and is adapted for connection thereto. Means is provided for connecting first inlet projection 41 to neck 25 of cylindrical tube 24 and can be, for example, first clamping ring 56; neck 25 slideably fits into first inlet projection 41. Means is also provided for connecting first outlet projection 47 to outlet tube 55 and can be, for example, second clamping ring 57; first outlet projection 47 slideably fits into yarn outlet tube 55.

To initiate string-up, the source of air under pressure 58 is activated, either manually or by some triggering device. The air the flow into cylindrical tube 24 via inlet pipe 30 and duct 31 to create suction which pulls at the entrance end of interfloor tube 19. The sound waves generated by this aspirator at and downstream of the discharge end of duct 31 are propagated towards the entrance and exit ends of interfloor tube 19, primarily the latter. For this reason, muffler 36 is located just downstream of neck 25 of cylindrical tube 24. The function of restrictor plate 32 is twofold. By confining the sectional area of opening 34 to approximately 25 to 75% of the inner sectional area of yarn passage 23, an increase in the velocity of air entering interfloor tube 19 at yarn passage 23 is achieved, thereby enhancing the pickup capability of interfloor tube 19. Restrictor plate 32 also serves to deflect some of the noise issuing from the entrance end of interfloor tube 19. An operator catches the advancing quenched filaments and throws them towards the entrance to interfloor tube 19 through which they are aspirated to be picked up by either a string-up aspirator or a panel aspirator 20 (FIG. 1). The source of air under pressure 58 is now turned off, and string-up is continued through further apparatus.

The sound waves propagated at and downstream of duct 31 travel into muffler 36 via perforated tube 49 where they are attenuated. Annular resonant chambers 52 formed by baffles 51, perforated tube 49, body 38, and end plate 45 attenuate the noise by wave reflections and phase mismatching. The sound absorbing material 53 filling each of annular resonant chambers 52 dissipates sound by transforming the acoustical mechanical energy into heat energy.

The volumes of annular resonant chambers 52, the number of perforations 50 in perforated tube 49, and the thickness of perforated tube 49 determines the resonance frequency of muffler 36. We have found that an open area of between 40 and 60% for perforated tube 49 is preferable when dealing with a frequency component situated in the high frequency levels, i.e., greater than 2,000 cycles per second, as is characteristic of the noise emitted by interfloor tube 19. If perforated tube 49 has an open area in excess of 60%, the resonance frequency of muffler 36 will be lowered, and if perforated tube 49 has an open area of less than 40%, the dissipative effect of muffler 36 will decrease.

As indicated, the preferred ratio of the length of perforated tube 49 to its inside diameter is between 6.2 to 1.0 and 15.5 to 1.0. It should be noted, however, that interfloor tube 19 and muffler 36 can function in conjunction with one another outside of this range, albeit with less advantageous results. An increase in the ratio corresponds to an increase in perforated tube 49 length and results in excess noise reduction; as the apparatus of the present invention reduces the noise issuing from interfloor tube 19 to 70 dB(A) (see Example 1 below) when the source of air under pressure is on, further noise reduction is not considered necessary.

The spacing between baffles 51 is determined by the frequency at which it is desired to tune muffler 36. When dealing with a frequency component situated in the high frequency levels, it is preferred that the ratio of the inside diameter of perforated tube 49 to the distance between adjacent baffles 51 be from 0.64 to 1.0 and 2.0 to 1.0. If the distance between adjacent baffles 51 is decreased, there is a corresponding decrease in the respective volumes of annular resonant chambers 52; if the distance between adjacent baffles 51 is increased, there is a corresponding increase in the respective volumes of annular resonant chambers 52. In either case, the resonant frequency will be changed, and less noise attenuation will occur.

Another feature of the present invention is the lack of angles or surfaces presented which can cause yarn end 14 to snag or to otherwise stop its descent through interfloor tube 19. Reference to FIGS. 2, 3, and 5 will show that all pipe fittings have been arranged so that the upstream pipe snugly fits inside the downstream pipe, and all potential angles have been tapered downward.

Also, by breaking muffler 36 into two major components, i.e., housing means 37 and sound absorbing insert 44, ready access to the interior of muffler 36 for any necessary replacement of sound absorbing material 53 is permitted. Alternately, sound absorbing insert 44 and housing means 37 can be constructed with end plate 45 as part of housing means 37.

The materials of construction are preferably as follows: for the sound absorbing material, asbestos fibers or an open-celled foam, for example, fine pore polyester urethane foam, more preferably the latter; for the sealing means, a resilient readily deformable elastomeric material, for example, silicone rubber; for the perforated tube, a metal such as stainless steel; for the screws, carbon steel; and for the other elements, a metal such as stainless steel or aluminum, more preferably the latter for reasons of economy.

EXAMPLE 1

The apparatus of the present invention was set up in a sound laboratory as shown in the drawings. Opening 34 in restrictor plate 32 had a sectional area of approximately 45% of the inner sectional area of yarn passage 23. The diameters of perforations 50 were approximately 0.075 inch, creating a total open area of approximately 50% for perforated tube 49. The ratio of the length of perforated tube 49 to its inside diameter was approximately 9.3 to 1.0 and the ratio of the inside diameter of perforated tube 49 to the distance between baffles 51 was approximately 0.96 to 1.0. A fine pore polyester urethane foam was utilized as the sound absorbing material 53, more specifically Scottfelt Grade 3-900 manufactured by the Scott Paper Company, Foam Division. The air supply line pressure was 90 psig, and the noise level was measured 6 inches and 90° from the center line of the exit end of interfloor tube 19. As muffler 36 fits in the piping system, readings were taken with muffler 36, and for the sake of comparison, without muffler 36. These readings were, respectively, 79 dB(A) and 112.5 dB(A), which corresponds to a dynamic insertion loss of 33.5 Δ dB(A). The 79 dB(A) noise level is well below the present and proposed eight hour maximum continuous noise exposure levels of, respectively, 90 and 85 dB(A).

Example 1 above illustrates said preferred apparatus of the present invention and is not to be considered limiting of the invention in any means. Various modifications and other advantages will be apparent to one skilled in the art, and it is intended that this invention be limited only as set forth in the following claims.

We claim:

1. An interfloor tube for conveying a continuous running length of yarn during the production of multifilament, synthetic yarn, said interfloor tube comprising:

A. a generally cylindrical yarn passage;

B. a generally cylindrical tube, said generally cylindrical tube surrounding and concentric with respect to said yarn passage and having a substantially larger diameter than that of said yarn passage, said tube starting a gradual inward taper at that point corresponding to the exit of said yarn passage and tapering to a neck having a diameter approximately equal to that of said yarn passage and downstream thereof;

C. means for mounting said yarn passage and said cylindrical tube in fixed relation to one another;

D. a source of air under pressure;

E. a duct, said duct being connected to said source of air under pressure through said cylindrical tube at the portion of said tube farthest away from that portion which tapers, said duct describing a half helical turn about the exterior of said yarn passage in the annular space left between said yarn passage and said cylindrical tube, said duct terminating just below said exit end of said yarn passage where said portion of said tube tapers, said duct delivering air under pressure to create suction when said source of air under pressure is turned on;

F. a restrictor plate, said restrictor plate being mounted so as to cover the entrances to said yarn passage and said cylindrical tube, said restrictor plate having an opening confined to that area covering said yarn passage to restrict entrance of air to said opening and said duct, said opening having an area which is approximately 25 to 75% of the cross sectional area of said yarn passage;

G. a muffler connected to said cylindrical tube, said muffler comprising:

i. housing means, said housing means comprising:

a. a generally cylindrical body having inlet and outlet ends;

b. a first inlet projection, said first inlet projection being generally cylindrical and hollow and extending outward from said inlet end of said body with which said first inlet projection is concentric, said first inlet projection having a diameter substantially smaller than that of said body and slightly larger than that of said tube at said neck, said first inlet projection being adapted for connection to said tube at said neck;

c. an annular wall, said annular wall connecting said body and said first inlet projection and lying in a plane substantially perpendicular to the central axis of said body; and d. a second inlet projection, said second inlet projection being generally cylindrical and hollow and extending inward from said inlet and of said body with which said second inlet projection is concentric, said second inlet projection having a diameter slightly smaller than that of said first inlet projection and being connected to said annular wall, the edge portion of said annular wall disposed between said first and said second inlet projections being beveled;

ii. a second absorbing insert, mounted within said housing means, said insert comprising:

a. an end plate, said end plate lying in a plane substantially parallel to said annular wall and being adapted for removable connection to said outlet end of said body of said housing means, said end plate having an orifice communicating with first and second generally cylindrical and hollow outlet projections, said first outlet projection extending outward from the plane of said end plate and being concentric with said body when said end plate is connected thereto, said first outlet projection having a diameter similar to that of said first inlet projection, said second outlet projection having a diameter slightly larger than that of said first outlet projection and extending inward from said plane of said end plate, said second outlet projection also being concentric with said body when said end plate is connected thereto, said orifice in said end plate having a periphery defined by said first and said second outlet projections with that edge portion of said end plate which is disposed therebetween being beveled;

b. a generally cylindrical perforated tube, said perforated tube having a plurality of perforations, the diameters of which are between 0.0675 and 0.0825 inch and which create an open area for said perforated tube of from 40 to 60%, the ratio of the length of said perforated tube to the inside diameter of said perforated tube being between 6.2 to 1.0 and 15.5 to 1.0, said perforated tube having an outside diameter slightly smaller than that of said second outlet projection and an inside diameter slightly larger than that of said second inlet projection, said perforated tube being slideably engaged with the exterior of said second inlet projection and said perforated tube extending to and mounted to the interior of said second outlet projection and said end plate being connected to said outlet end of said body of said housing means, the central axis of said perforated tube substantially coinciding with that of said body;

c. a plurality of annular baffles, said annular baffles being connected to an encircling said perforated tube in a plane substantially perpendicular to said central axis thereof, the peripheries of said annular baffles being defined by said body when said end plate is connected thereto, said annular baffles being disposed at substantially equal intervals and such that the ratio of the inside diameter of said perforated tube to the distance between two adjacent baffles is from 0.64 to 1.0 and 2.0 to 1.0, the distance between the baffle nearest said annular wall and said annular wall and the distance between the baffle nearest said end plate and said end plate being the same and approximately equal to said distance between two adjacent baffles, said baffles forming in conjunction with said perforated tube, said body, said annular wall, and said end plate a plurality of annular resonant chambers when said end plate is connected to said outlet end of said body of said housing means;

d. sound absorbing material disposed throughout and within each of said annular resonant chambers; and e. means for fixedly assembling the elements of said insert;

iii. means for connecting said end plate of said insert to said body of said housing means;

H. a yarn outlet tube, said yarn outlet tube having a diameter slightly larger than said second outlet projection and being adapted for connection thereto;

I. means for connecting said first inlet projection to said neck of said cylindrical tube; and J. means for connecting said first outlet projection to said yarn outlet tube; whereby the noise level of said interfloor tube is reduced up to 33.5 Δ dB (A) by said muffler when said source of air under pressure is being supplied to said outlet.

2. The apparatus of claim 1 wherein said ratio of the length of said perforated tube to the inside diameter of said perforated tube is approximately 9.3 to 1.0.

3. The apparatus of claim 1 wherein said restrictor plate opening has a sectional area which is approximately 45% of the cross sectional area of said yarn passage.

4. The apparatus of claim 1 wherein said ratio of the inside diameter of said perforated tube to the distance between two adjacent baffles is approximately 0.96 to 1.0.

5. The apparatus of claim 1 wherein the diameters of said perforations are approximately 0.075 inch.

6. The apparatus of claim 1 wherein said sound absorbing material is selected from the group consisting of asbestos fibers or fine pore polyester urethane foam.

7. The apparatus of claim 1 wherein said open area for said perforated tube is approximately 50%.

8. An apparatus to convey a continuous running length of yarn through an obstruction for use during the production of multifilament, synthetic yarn, said apparatus comprising:

A. an elongated tube, said elongated tube having an entrance and an exit end for yarn passage;

B. a source of air under pressure, said source of air under pressure being connected to said elongated tube so as to create a suction therethrough when operational; and C. a muffler, said muffler being located downstream of said source of air under pressure and being connected to and replacing a portion of said elongated tube corresponding in length to said muffler, said muffler comprising:

i. housing means, said housing means comprising:

a. an inlet end, said inlet end being shaped so as to couple with said elongated tube downstream of said source of air under pressure without blocking said yarn passage therethrough;

b. an outlet end, said outlet end being shaped so as to couple with said elongated tube upstream of said exit end of said elongated tube without blocking said yarn passage therethrough; and c. an elongated section extending between said inlet end and said outlet ends of said housing means;

ii. a perforated tube, said perforated tube having a diameter substantially smaller than the diameter of said housing means, said perforated tube being disposed between said inlet and said outlet ends of said housing means and having an open area of from 40 to 60%.

iii. a plurality of baffle means, said baffle means being disposed approximately perpendicular to the central axes of said perforated tube and said housing means and being shaped so as to encircle said perforated tube with their peripheries being surrounded by said elongated section of said housing means, said baffle means forming in conjunction with said perforated tube and said housing means a plurality of annular resonant chambers; and iv. sound absorbing material disposed throughout each of said resonant chambers;

D. means for connecting said inlet end of said housing means with said elongated tube downstream of said source of air under pressure; and E. means for connecting said outlet end of said housing means with said elongated tube upstream of said exit end;

whereby the noise level of said apparatus when said source of air under pressure is operational is reduced up to 33.5 Δ dB (A) by said muffler.

9. The apparatus of claim 8 wherein said housing means has a substantially cylindrical shape.

10. The apparatus of claim 8 wherein the ratio of the length of said perforated tube to the inside diameter of said perforated tube is approximately between 6.2 to 1.0 and 15.5 to 1.0.

11. The apparatus of claim 8 wherein the ratio of the inside diameter of said perforated tube to the distance between two adjacent baffles is approximately from 0.64 to 1.0 and 2.0 to 1.0, the distance between the baffle nearest said inlet end of said housing means and the distance between the baffle nearest said outlet end of said housing means being the same and approximately equal to said distance between two adjacent baffles.

12. The apparatus of claim 8 wherein said sound absorbing material is selected from the group consisting of asbestos fibers or fine pores polyester urethane foam.

* * * * *

UNITED STATES PATENT AND TRADEMARK OFFICE

CERTIFICATE OF CORRECTION

PATENT NO. : 4,030,651
DATED : June 21, 1977
INVENTOR(S) : William Robert Weiss, James Judson Cooksey, Wilbur Leon Stables and Harry Lee Newell, Jr.

It is certified that error appears in the above-identified patent and that said Letters Patent are hereby corrected as shown below:

Column 1, line 42, "cathces" should read --catches--.

Column 1, line 57, after "time" insert --it--.

Column 2, line 22, "interior" should read --interfloor--.

Column 2, line 33, "of" should read --for--.

Column 3, line 41, "th" should read --the--.

Column 5, line 49, "rtube" should read --tube--.

Column 5, line 61, "the flow" should read --then flows--.

Column 7, line 65, after "exit" insert --end--.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*